United States Patent [19]

Feuling

[11] Patent Number: 5,033,581

[45] Date of Patent: Jul. 23, 1991

[54] MUFFLER FOR AN INTERNAL COMBUSTION ENGINE

[75] Inventor: James J. Feuling, Ventura, Calif.

[73] Assignee: Feuling Engineering, Inc., Ventura, Calif.

[21] Appl. No.: 416,730

[22] Filed: Oct. 2, 1989

[51] Int. Cl.[5] ..... F01N 1/24

[52] U.S. Cl. ..... 181/257

[58] Field of Search ..... 181/251, 257, 268, 275, 181/240, 269

[56] References Cited

U.S. PATENT DOCUMENTS

| | | | |
|---|---|---|---|
| 1,591,088 | 7/1926 | Holmes | 181/251 |
| 1,740,805 | 12/1929 | Brice | 181/251 |
| 4,712,644 | 12/1987 | Sun | 181/251 |
| 7,019,697 | 11/1935 | Smith | 181/251 X |

FOREIGN PATENT DOCUMENTS

| | | | |
|---|---|---|---|
| 1180573 | 10/1964 | Fed. Rep. of Germany | 181/268 |
| 602160 | 3/1926 | France | 181/206 |
| 488847 | 1/1954 | Italy | 181/268 |
| 86624 | 7/1917 | Switzerland | 181/206 |
| 2056555 | 3/1981 | United Kingdom | 181/240 |

*Primary Examiner*—Brian W. Brown
*Attorney, Agent, or Firm*—Frank D. Gilliam

[57] ABSTRACT

A muffler for use with an internal combustion engine or the like having improved attenuation capabilities. The muffler of the disclosure comprises at least two separate passages interconnected in series with a single or multiple output exhaust manifold and a single or multiple tail pipe of an engine exhaust system. At least one of the passages has a length greater than the other or others. The total cross-sectional area of the passages is approximately equal to or greater than the cross-section of the single or multiple exhaust manifold and single or multiple tail pipe to eliminate back pressure and maintain column inertia. In an embodiment, a housing encloses the passages and the overall appearance is that of a conventional muffler. In still another embodiment, at least one of the passages within the housing are perforated with a plurality of apertures. These apertures can be all of the same dimension or can be of different cross-sectional areas. In still another embodiment, the space between the passages and the inside housing walls is filled with a sound absorbing material.

35 Claims, 2 Drawing Sheets

MUFFLER FOR AN INTERNAL COMBUSTION ENGINE

BACKGROUND OF THE INVENTION

The invention relates in general to sound attenuation and, more specifically, to mufflers for use with internal combustion engines.

In many devices such as internal combustion engines, turbine engines, compressed gas powered tools, air handling systems, etc., considerable noise energy is generated and travels with the fluid or gasses. Such noise is objectionable and must be reduced prior to exit from a noisy device. A wide variety of "mufflers" and other noise reducing devices have been developed and used.

Some mufflers use a plurality of baffles which radically change the path of the exhaust gas over a short distance. While such mufflers may be effective in reducing noise levels, they create undesirable high back pressure on the engines, resulting in lower engine power and efficiency.

Other mufflers direct gasses straight through a perforated tube with sound absorbing material such as, glass fibers in the form of "glass wool" between the tube and outer housing. These so called "glass-pack" mufflers generally produce low back pressure but are not satisfactory in reducing noise levels.

Generally speaking, prior art mufflers have flow through resistance, produce acoustic wave reflection and have loss of column inertia.

Many attempts have been made to produce the ideal muffler. Some of these attempts can be found in the following U.S. Pat. Nos. 1,934,462; 1,922,848; 2,046,193; 2,826,261; 4,239,091; 4,632,216; 4,671,381; 4,674,594 and 4,690,245 and others. None of these prior art mufflers have reached an ultimate of sufficient reducing sound while maintaining column inertia with minimum flow loss.

Also some of these prior art mufflers are complex to manufacture, heavy in weight and overly large for the purpose intended and others have a short life due to corrosion or are susceptible to burn out from the heat of the gasses passing therethrough.

Applicant's prior U.S. Pat. No. 4,263,982 and 4,834,214 have considerably advanced the muffler art.

There is, however, a continuing need to further improve the sound attenuation reducing noise pollution. The muffler of the present invention advances the current state of the muffler art in this desired area.

SUMMARY OF THE INVENTION

Problems that exist in even the most improved mufflers are further reduced by the introduction of the muffler of the present invention and the various embodiments thereof.

The present improved muffler includes an embodiment that consists of at least two passages one of which is longer in length then the other. One example utilizes two tubular conduits with one of the tubular conducts substantially twice the length of the other. Another example utilizes one tubular conduct more than twice the length of the other conduit. Another example utilizes three conduits with two of the conduits substantially the same length and the third a different length. Other examples utilize four conduits of from one to four different lengths. The various embodiments can be used for attenuating noise from two inputs to a single output, multiple inputs to multiple outputs or from a single input to two outputs. All of the passages together in all embodiments have either substantially the same diameter or slightly diverge in the downstream direction and their combined cross-sectional area is equal to or greater than the cross-sectional area of the header entry or entries into the muffler and the out put can be substantially equal to or greater in cross section than the input end of the muffler. The engine noise is greatly attenuated thereby. It is believed that the attenuation of the exhaust noise of the engine is accomplished by the blending of out of phase noise frequencies at the output of the two different length conduits (one being approximately 180 degrees out of phase with the other) as they enter the tail pipe. In a second embodiment, a housing surrounds the conduits in a relationship that seals the conduits from the atmosphere. If desired to further enhance the exhaust noise attenuation, one or more of the conduits can be perforated or slotted with equal diameter or different diameter apertures. It is further found that perforations of a plurality of different diameters in one or more of the conduits also further attenuate the exhaust noise. A still further embodiment includes filling the void areas between the outer walls of the conduit and the inside surface of the housing in the second embodiment with steel wool, glass wool and other sound absorbing materials or any combination of different sound absorbing materials. This inclusion of sound absorbing material further reduces the exhaust noise exiting the muffler. These various different embodiment of the basic muffler of the invention substantially reduce the expected noise levels from an internal combustion and yet maintain substantially no back pressure to the engine and maintain or enhance column inertia through the muffler. It can be appreciated that the manufacture of the various embodiments of the present muffler is no more difficult or complex to construct or use than the present state of the art mufflers and in several of the embodiments of the present invention it is less difficult and less expensive to manufacture the muffler and the resulting muffler has a greater propensity to both reduce exit noise and retain the desired column inertia than the best of the present state of the art mufflers.

It is an object of this invention to produce an internal combustion engine muffler that reduces exhaust noise and maintains ideal column inertia and reduces back pressure.

It is another object of this invention to produce an internal combustion engine muffler that consists of a minimum of stamped or formed components.

It is yet another object of this invention to produce an internal combustion engine muffler that has a small overall profile which is readily adaptable to a modern motor vehicle.

Still another object of this invention is to produce a more efficient muffler that is low in economic cost and has a long expected life.

Yet another object of this invention is to produce a low noise muffler for attachment to either single or multiple exhaust inputs or outputs.

Other advantages and features of the invention will become apparent form the following description of several embodiments thereof, shown in the attached drawings, in which:

BRIEF DESCRIPTION OF THE DRAWING FIGURES

DETAILED DESCRIPTION OF THE PREFERRED EMBODIMENTS OF THE INVENTION

Figure 6:
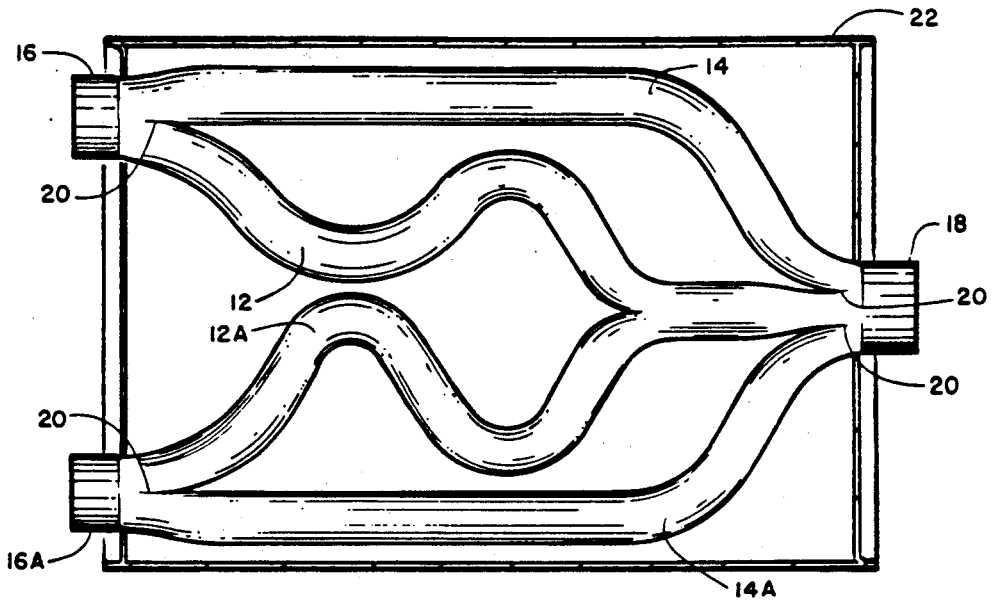
FIG. 6 is a top plan in cutaway showing of an embodiment of the muffler of the invention having four conduits enclosed in a typical muffler housing.

Referring to the various drawing Figures and specifically to FIGS. 1 through 4. The muffler 10 of the present invention comprises at least a pair of side by side defined gas passages. A single pair and two pairs are shown for ease of explanation as conduits 12 and 14 and 12, 12A, 14 and 14A. The input 16 and inputs 16 and 16A and output 18 and 18 and 18A to and from the muffler respectfully may have substantially the same cross-sectional area or may diverge slightly in the downstream direction. The cross-sectional area of 16 and 18 or 16, 16A, 18 and 18A are substantially "A" and the conduits 12 and 14 and 12, 12A, 14 and 14A have substantially the same cross-sectional area equal to "A/2" and "A/4" respectfully. A narrow blade member or members 20 separates the conduits at the input 16 and output 18. The difference in length of the two conduits 12 (12A) and 14 (14A) can be a few inches to 12 (12A) being a multiple of the length of conduit 14 (14A). The lengths of the conduits 12 (12A) and 14 (14A) are determined by the sound frequencies to be attenuated within the muffler. The different lengths of conduits 12 12A) and 14 (14A) provide a phase differential to the portion of the acoustic wave traveling through conduit 12 (12A) relative to conduit 14 (14A) at the output end 18. This phase differential provides a cancelling effect to the noise recombining at the muffler output end 18. By experimenting with the relative lengths of the conduits 12 (12A) and 14 (14A) different known engine exhaust noise frequencies can be successfully attenuated. It should be understood that when the conduits slightly diverge in the downstream direction that the output end of the conduit has a cross sectional area slightly greater than the input end and accordingly the total combined cross sectional area of the conduits is greater than "A".

Figure 1:
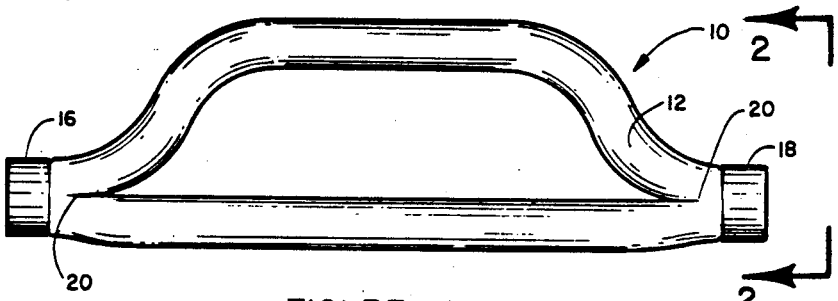
FIG. 1 depicts a top plan view of one embodiment of the muffler of the invention employing two gas passages of different lengths therethrough.
Figure 2:
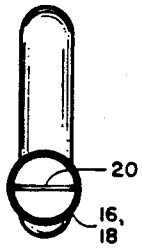
FIG. 2 depicts an view taken along line 2—2 of FIG. 1.
Figure 3:
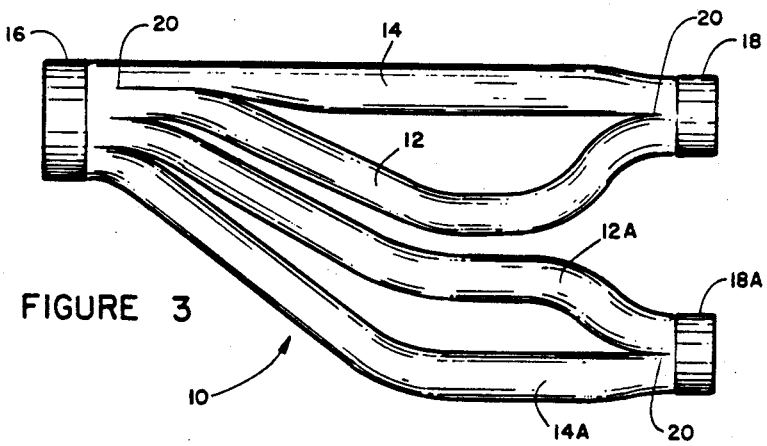
FIG. 3 depicts a top plan view of another embodiment of the muffler of the invention employing four gas passages of different lengths extending from a single input to two outputs.
Figure 4:
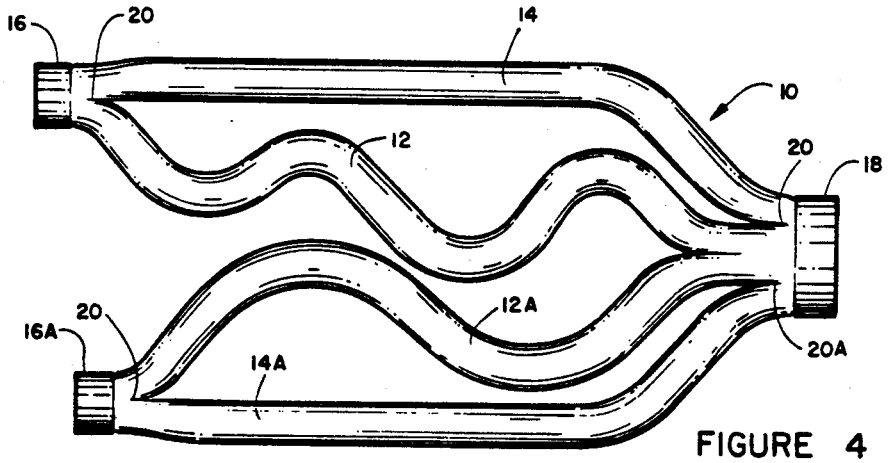
FIG. 4 depicts a top plan view of another embodiment of the muffler of the invention employing four conduits with two inputs and a single output.
Figure 8:
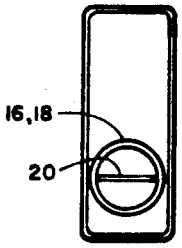
FIG. 8 is an end view of FIG. 5 taken along line 8—8.
Figure 5:
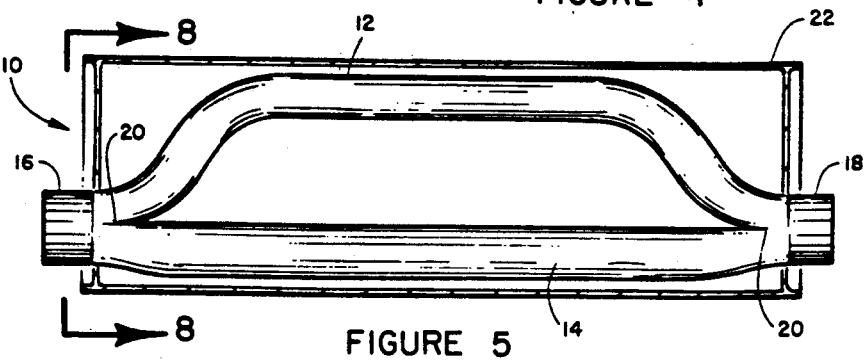
FIG. 5 is a top view in cutaway showing of the Muffler of FIG. 1 encased in a typical muffler housing.

FIG. 2 depicts a typical end section or sections 16 (16A) or 18 (18A) of the FIG. 1 muffler showing the blade 20. Although the input and output end or ends of the muffler show conduits 12 (12) and 14 (14A) as semicircular at their joinder, this configuration is shown only for ease of explanation and not by way of limitation as the joinder of the two conduits can take any convenient form while keeping in mind the necessity of maintaining substantially a uniform cross-sectional "A" at he input and output of the muffler and approximately "A/2" or "A/4" each for the conduits 12 (12A) and 14 (14A).

Although the above discussion describes either two or four conduits as having a cross-sectional area of "A/2" or "A/4" with a total cross-sectional area of "A", it should be understood that the principle concern of the muffler of the invention is to maintain column inertia through the exhaust system, that is, that the cross-sectional area through type muffler 10 be substantially equal to or greater than the output cross-sectional area of the exhaust header or headers and the tail pipe or tail pipes. This end can be achieved by employing conduits 12 (12A) and 14 (14A) of a different cross-sectional area so long as the sum or total cross-sectional area of the two conduits 12 (12A) and 14 (14A) substantial equal "A" or greater in cross-sectional area.

Referring specifically to drawing FIGS. 5–8 wherein different embodiments of the present invention are shown. The FIGS. 5–9 embodiments of the invention are substantially the same as the FIG. 1–4 showing except that the muffler of the drawing FIGS. 1–4 is encased in a air sealed housing or shell 22. The housing or shell resembles a conventional muffler outer form and can be curvilinear, rectilinear or combinations thereof.

Figure 7:
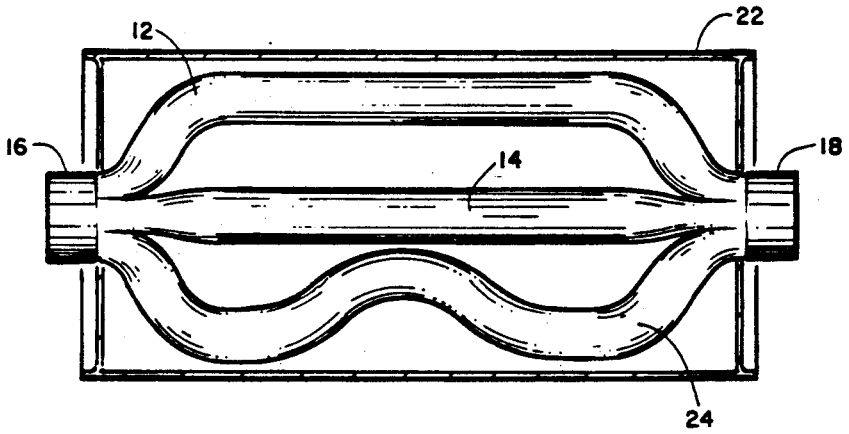
FIG. 7 is a top view in cutaway of another embodiment of the muffler of the invention employing three defined gas passages of at least two different lengths therethrough.

FIG. 7 depicts a muffler of the invention with three separate gas flow conduits 12, 14 and 24. The combined cross-section of the three conduits being substantially equal to or greater than "A" in total cross-section. The three conduits may be the same or different in cross-sectional area.

Figure 9:
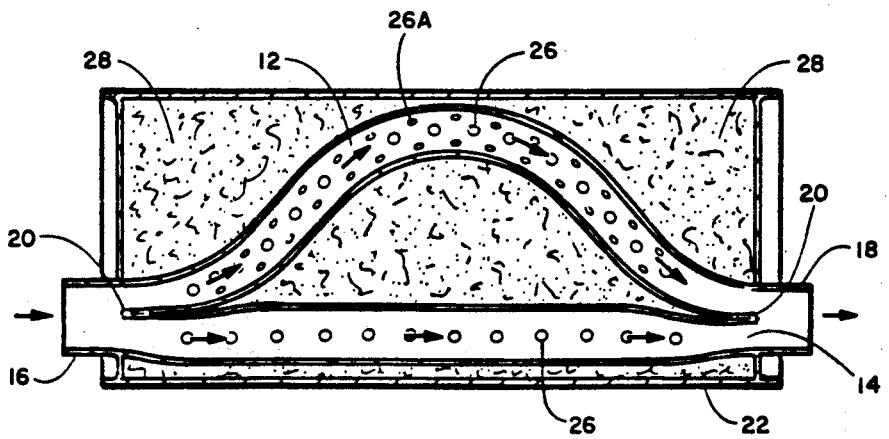
FIG. 9 is a plan view showing of the muffler of the invention encased in a housing as seen in FIGS. 3 and 6 with the defined gas passages perforated through the surface thereof and the voids between the defined gas passages filed with high temperature sound suppression material.

FIG. 9 is a further embodiment of the muffler of drawing FIG. 1 and includes plurality of perforations 26 though the walls of conduits 12 and 14 and a filler of a sound absorbing material 28 which is not effected by the extremely high operation temperatures of the muffler. The perforations 26 may be rectilinear or curvilinear and may be of only one cross-sectional area or a plurality of two or more different cross-sectional areas. The sound absorbing material can be, for example, a fibrous material such as, for example steel wool, glass, Kevlar or the like suitable for the purpose intended. It should be noted however, that the sound absorbing material is not limited to a fibrous material as any sound absorbing material suitable for the purpose intended can be employed for this purpose.

Although in FIG. 9 only two encased conduits are shown it should be understand that any embodiment shown or any other multiple of conduits 12 and 14 may be encased as shown in FIG. 9 to practice the invention.

While certain specific proportions, materials and arrangements have been detailed in the above description of the preferred embodiments of the invention, these may be varied, where suitable, with similar results. For Example, the muffler components may be formed from any suitable materials of construction, such as, for example and not by way of limitation, steel, aluminum, reinforced plastic etc. and may be manufactured by stamping, hydroforming, rolling, cold forming, etc.

Other variations, ramifications and applications of this invention will occur to those skilled in the art upon reading the present disclosure. These are intended to be included within the scope of this invention or defined in the appended claims.

What is claimed is:

1. An improved sound attenuation device having an input and output end comprising:

two or more defined passage means having walls positioned between said input and said output end of said attenuation device for communication between said input and output end, at least one of said two or more defined passage means is perforated by perforations through said walls and said defined passage means having a total combined cross-section at least substantially equal to said input end.

2. The sound attenuation device as defined in claim 1 wherein said two or more defined passage means are of at least two different lengths to create an out of phase condition to sound traveling between said input and output.

3. The sound attenuation device as defined in claim 1 wherein said at least two of two or more defined passage means are tubular.

4. The sound attenuation device as defined in claim 1 wherein said two or more defined passage means number two.

5. The sound attenuation device as defined in claim 1 wherein said two or more defined passage means number three.

6. The sound attenuation device as defined in claim 1 wherein said two or more defined passage means number four.

7. The sound attenuation device as defined in claim 1 wherein at least one of said two or more defined passage means is of a different cross-section then the other passage means of said two or more defined passage means.

8. The sound attenuation device as defined in claim 1 wherein said perforations are rectilinear.

9. The sound attenuation device as defined in claim 1 wherein said perforations are curvilinear.

10. The sound attenuation device as defined in claim 1 wherein said perforations are louvers with their distal ends spaced from said walls of said two or more defined passage means.

11. The sound attenuation device as defined in claim 1 wherein the walls of said two or more defined passage means are perforated.

12. The sound attenuation device as defined in claim 11 wherein said perforations are of at least two different sizes.

13. The sound attenuation device as defined in claim 1 further comprising a sealed housing surrounding said two or more defined passage means with voids between said housing and said two or more defined passage means.

14. The sound attenuation device as defined in claim 13 further comprising filling said voids with a sound absorbing material.

15. The sound attenuation device as defined in claim 1 wherein a thin wall is provided for a joinder of said two or more defined passage means at both the input and output end.

16. The sound attenuation device as defined in claim 1 wherein said two or more passages have substantially uniform end to end cross-sections.

17. The sound attenuation device as defined in claim 1 wherein said combined cross-section of said two or more defined passage means is substantially equal to said output.

18. The sound attenuation device as defined in claim 1 wherein said combined cross-section of said two or more defined passage means is greater than a cross-section of said input.

19. An improved sound attenuation device having an input and output end comprising:

two or more defined passage means positioned between said input and said output end of said attenuation device for communication between said input and output end, each of said two or more defined passage means having a total combined cross-section at least substantially equal to a cross-section of said input end and at least one of said two or more defined passage means diverge in a downstream direction between said input and output end and a sealed housing surrounding said two or more defined passage means with voids between said housing and said two or more defined passage means, said voids being filled with a sound absorbing material.

20. The sound attenuation device as defined in claim 19 wherein said two or more defined passage means are of at least two different lengths to create an out of phase condition to sound traveling between said input and output.

21. The sound attenuation device as defined in claim 19 wherein said two or more defined passage means are tubular.

22. The sound attenuation device as defined in claim 19 wherein said two or more defined passage means number two.

23. The sound attenuation device as defined in claim 19 wherein said two or more defined passage means number three.

24. The sound attenuation device as defined in claim 19 wherein said two or more defined passage means number four.

25. The sound attenuation device as defined in claim 19 wherein at least one of said two or more defined passage means are of a different cross-section.

26. The sound attenuation device as defined in claim 19 wherein at least one of said two or more defined passage means is perforated.

27. The sound attenuation device as defined in claim 26 wherein said perforations are rectilinear.

28. The sound attenuation device as defined in claim 26 wherein said perforations are curvilinear.

29. The sound attenuation device as defined in claim 26 wherein said perforations are louvers with their distal ends spaced from the walls of said two or more defined passage means.

30. The sound attenuation device as defined in claim 19 wherein said walls of said two or more defined passage means are perforated.

31. The sound attenuation device as defined in claim 30 wherein said perforations are of at least two different cross-sectional area areas.

32. The sound attenuation device as defined in claim 19 wherein a thin wall is provided for a joinder of said two or more defined passage means at both the input and output end.

33. The sound attenuation device as defined in claim 19 wherein said two or more defined passage means have substantially uniform end to end cross-sections.

34. The sound attenuation device as defined in claim 19 wherein said combined cross-section is substantially equal to the cross-section of the input.

35. The sound attenuation device as defined in claim 19 wherein said combined cross-section is greater than the cross-section of said input.

* * * * *